US007083297B2

(12) United States Patent
Matthews et al.

(10) Patent No.: US 7,083,297 B2
(45) Date of Patent: Aug. 1, 2006

(54) FLASHLIGHT WITH LENS FOR TRANSMITTING CENTRAL AND OFF-AXIS LIGHT SOURCES

(75) Inventors: John W. Matthews, Newport Beach, CA (US); Paul Y. Kim, Irvine, CA (US)

(73) Assignee: Surefire LLC, Fountain Valley, CA (US)

( * ) Notice: Subject to any disclaimer, the term of this patent is extended or adjusted under 35 U.S.C. 154(b) by 79 days.

(21) Appl. No.: 10/732,874

(22) Filed: Dec. 9, 2003

(65) Prior Publication Data

US 2005/0122711 A1 Jun. 9, 2005

(51) Int. Cl.
*F21V 7/00* (2006.01)
*H01J 5/16* (2006.01)

(52) U.S. Cl. ..... 362/184; 362/183; 362/244; 362/235; 362/545

(58) Field of Classification Search ..... 362/184, 362/183, 244, 235, 545
See application file for complete search history.

(56) References Cited

U.S. PATENT DOCUMENTS 1,922,618 A * 8/1933 Dickson ..... 362/235
2,215,900 A 9/1940 Bitner
4,214,295 A * 7/1980 Morton ..... 362/164
4,770,514 A 9/1988 Silverglate
4,803,605 A 2/1989 Schaller et al.
5,485,317 A 1/1996 Perissinotto et al.
5,629,105 A 5/1997 Matthews
5,642,932 A 7/1997 Matthews
5,757,557 A 5/1998 Medvedev et al.
5,871,272 A 2/1999 Sharrah et al.
6,305,818 B1 10/2001 Lebens et al.
6,386,730 B1 5/2002 Matthews
6,811,289 B1 * 11/2004 Nakata ..... 362/516
6,908,218 B1 * 6/2005 Sato et al. ..... 362/268
6,945,672 B1 * 9/2005 Du et al. ..... 362/241

FOREIGN PATENT DOCUMENTS

GB 2085569 A * 4/1982

OTHER PUBLICATIONS

Product data sheet: "Luxeon Technical Data Luxeon Collimator (LXHL-NX05)" Lumileds lighting, LLC, Feb. 2002.
Product data sheet: "Luxeon Technical Data Luxeon Emitter" Lumileds lighting, LLC, Jan. 2002.

* cited by examiner

*Primary Examiner*—Sandra O'Shea
*Assistant Examiner*—Anabel Ton
(74) *Attorney, Agent, or Firm*—Bennet K. Langlotz; Langlotz Patent Works, Inc.

(57) ABSTRACT

A flashlight has a lens having an optical axis, with a first light source positioned on the optical axis. A second light source is spaced apart from the first light source away from the optical axis, and the lens has an aperture registered with the second light source. The lens may have a central portion configured to transmit axially-emitted light from the first light source, and the lens having a peripheral portion having an internally reflective surface configured to reflect laterally-emitted light from the light source in a direction more closely aligned with the optical axis. The first light source may be positioned within a recess in the lens, and the aperture may be formed in the peripheral portion of the lens. The light sources may be LEDs, and may be of different colors.

17 Claims, 2 Drawing Sheets

FLASHLIGHT WITH LENS FOR TRANSMITTING CENTRAL AND OFF-AXIS LIGHT SOURCES

FIELD OF THE INVENTION

This invention relates to flashlights, and more particularly to flashlights with multiple light sources.

BACKGROUND OF THE INVENTION

Flashlights are conveniently sized battery powered portable light sources, which provide the user with a source of illumination. Said illumination could be white light or light of a specific color, or even light outside the visible range of wavelengths, such as ultra violet or infrared radiation. The "color" or wave length of the light will depend on the nature of the light source or light sources used in the flashlight. Typical light sources or "lamps" are tungsten filament lamps, ARC lamps, light emitting diode (LED) lamps, lasers, and any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

Multiple lamp flashlights have proven effective to provide dual light levels, and dual color choices. An examples of such prior art systems is described in U.S. Pat. No. 5,629,105 to Matthews, incorporated herein by reference, and which describes the use of a main tungsten filament lamp at the focus of a parabolic reflector, with a separately-switched second lamp protruding or shining through the reflector at a point offset to the side of the main lamp. The second lamp may be an LED of any selected color, and one successful version of this flashlight has an array of three such LED lamps, each with an encapsulated body having a curved front lens surface that serves to collimate the emitted light.

The use of a parabolic reflector is reasonably effective for tungsten lamps having a filament emitting light in a nearly omnidirectional pattern, because it efficiently captures the bulk of the light emitted laterally and somewhat rearwardly. In contrast, a reflector is less efficient for LED light sources that emit the bulk of their light in a generally forward direction, with less emitted laterally, and minimal rearward emissions. A conventional reflector system allows the forward cone of emissions that does not strike the reflector to illuminate a broad circle defined by the shadow of the forward rim of the flashlight housing. For a typical configuration, this unfocused direct illumination represents about 20–30% of the output of the tungsten lamp, leaving an appreciable portion of the lamps emission to be reflected and focused to a bright spot. In contrast, with an LED lamp suited for primary flashlight illumination, the same reflector geometry may allow up to 60% of illumination to go unfocused, providing a central spot of inadequate brightness.

SUMMARY OF THE INVENTION

The present invention overcomes the limitations of the prior art by providing a flashlight having a lens with an optical axis. A first light source is positioned on the optical axis, and a second light source is spaced apart from the first light source away from the optical axis. The lens has an aperture registered with the second light source. The lens may have a central portion configured to transmit axially-emitted light from the first light source, and the lens having a peripheral portion having an internally reflective surface configured to reflect laterally-emitted light from the light source in a direction more closely aligned with the optical axis. The first light source may be positioned within a recess in the lens, and the aperture may be formed in the peripheral portion of the lens. The light sources may be LEDs, and may be of different colors.

DETAILED DESCRIPTION OF A PREFERRED EMBODIMENT

Figure 1:
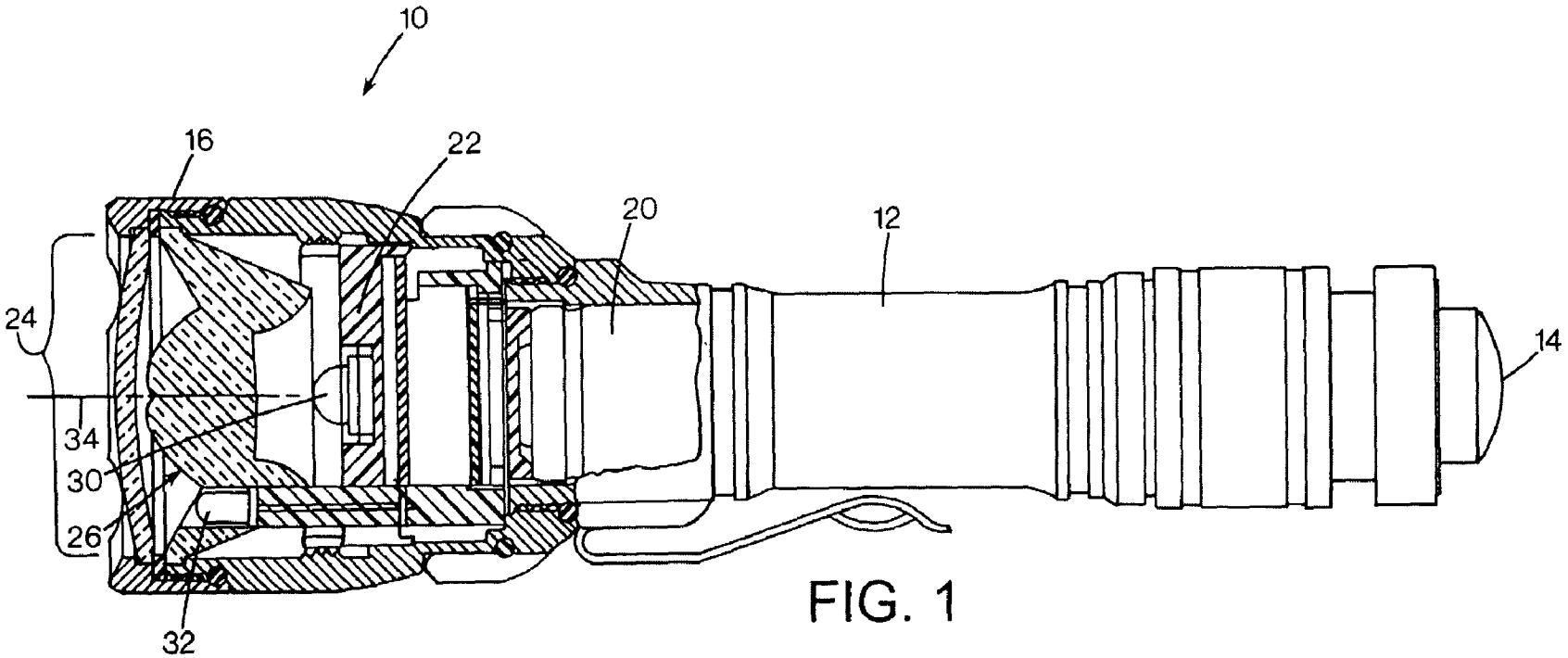
FIG. 1 is a sectional side view of a flashlight according to a preferred embodiment of the invention.

FIG. 1 shows a schematic drawing of a flashlight 10 according to a preferred embodiment of the invention. The flashlight has an elongated cylindrical metal housing 12 having a rotary tail cap switch 14 at a rear end, and a lamp bezel 16 at a forward end. The housing body contains one or more batteries 20, which are connected at their rear end to the switch, and at their forward end to a circuit element 22. The housing forms a conductive path to complete a circuit between the batteries, switch and board.

A lamp assembly 24 is received within the bezel, and includes a lens 26, a central LED lamp 30, and one or more secondary LED lamps 32. The lens is a transparent body with specular surfaces, having a compound form of different flat and curved primary reflecting and refracting surfaces, all of which are surfaces of revolution about an optical axis 34 of the lens, which coincides with the axis of the flashlight housing. The central LED is positioned on the optical axis 34, and the secondary LEDs are positioned away from the axis. In the preferred embodiment, the three secondary LEDs are positioned away from the axis by the same radial distance, and are angularly positioned evenly on a circle, 120 degrees apart from each other. IN alternative embodiments, the number of secondary LEDs may range between one and number limited only by the space to position them. The conductive leads of each LED are electrically connected to the circuit element 22, which may include switching, power controllers, and other programmable capabilities to operate the central lamp and the secondary lamps independently of each other, based on an input from the switch.

Figure 2:
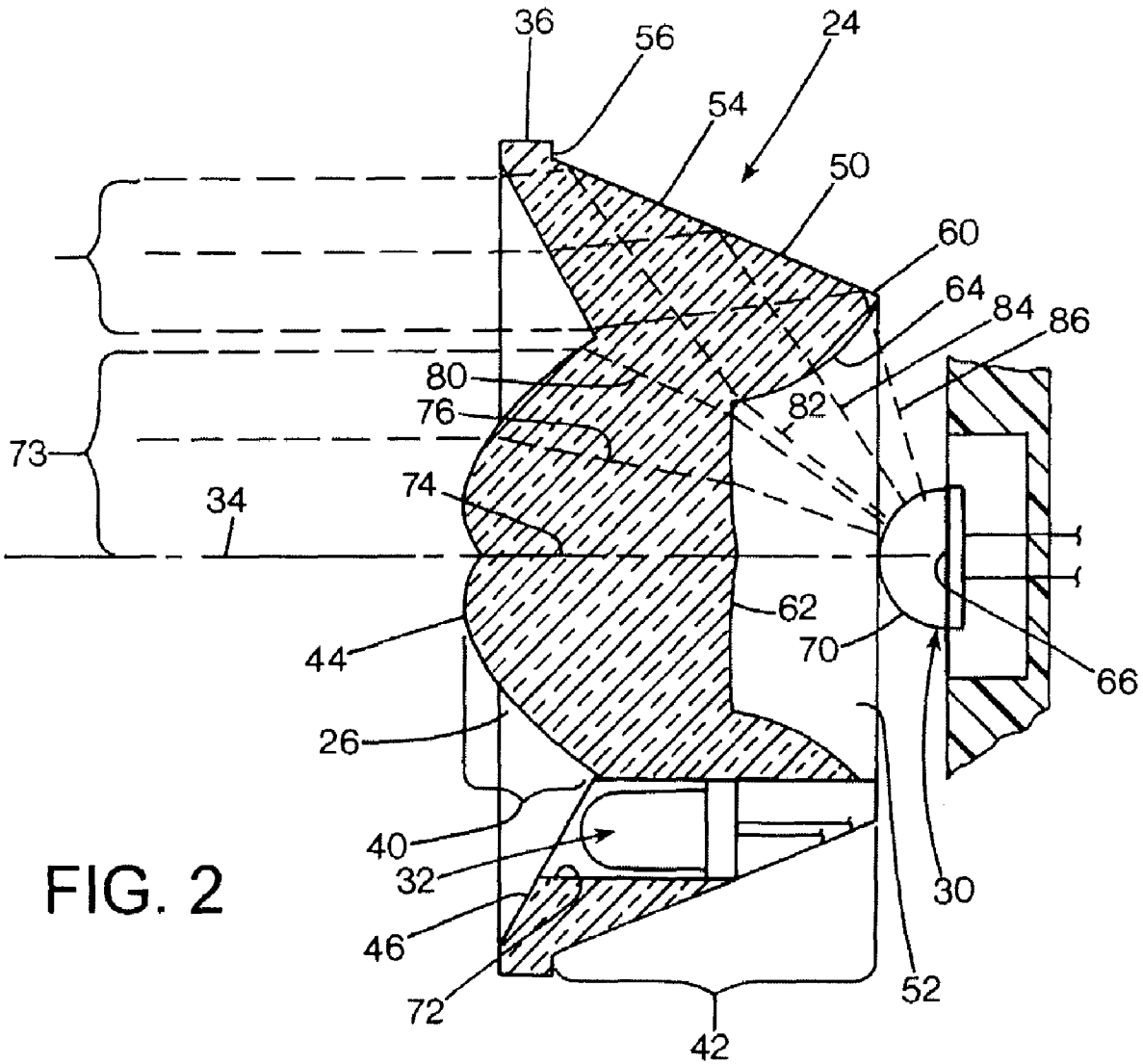
FIG. 2 is a sectional side of a lamp and lens assembly according to the embodiment of FIG. 1.

As shown in FIG. 2, the lens 26 is a unitary body of transparent material, such as acrylic or any other optical material that is readily formed into the indicated shape. The lens has a flange 36 that provides a division between a forward lens portion 40 and a rearward lens portion 42. In the preferred embodiment, the flange has a diameter of 1.26 inch and a thickness of 0.08 inch.

The forward lens portion consists of a central dome 44 that protrudes from a broadly-tapered conical forward peripheral surface 46. The dome is a surface of revolution centered on the optical axis 34, and has a complex figure established to approximately collimate a central conical bundle of rays emitted by the central LED. The central bundle includes on-axis rays, and those rays that deviate from the axis by a limited amount. The dome has a complex aspheric shape to account for the shape and size of the light source, and the other surfaces through which the pertinent rays pass. The dome protrudes from the inner junction with the peripheral surface 46 by a maximum of 0.21 inch, and has a maximum diameter of 0.67 inch, which is significantly less than the flange diameter, to allow for certain other rays to pass through the peripheral surface 46 as will be discussed below.

The rear portion 42 of the lens is a conical protrusion 50 that defines a central recess 52. The protrusion 50 has a conical outer surface 54, which may in alternative embodiments be parabolic or curved, depending on the optical performance requirements. The surface may be a deviation from a cone to correct for refraction introduced at another pertinent lens surface, and to account of the shape of the light source. The surface 54 has a largest diameter of 1.2 inch where it joins the rear surface 56 of the flange, and extends rearwardly to a maximum distance of 0.50 inch from the flange rear surface. The rearmost portion of the surface 54 is at an axially-centered circular rim 60 that defines the opening of the recess 52.

The recess 52 is a cylindrical pocket having a generally flat floor 62 and a toroidal side wall 64 that flares I the manner of a trumpet bell. The floor deviates slightly from a planar condition, as it is provided with a slight optical figure to provide the desired beam characteristics. The rim 60 has a diameter of 0.77 inch, and the recess has a depth of 0.22 inch. In alternative embodiments, the recess may have other forms, including a flat, convex or concave floor, a cylindrical, concave or convex sidewall (positively or negatively curved toroid), and with or without the discontinuity or seam at the junction of the floor and the wall. In other embodiments, the lamp 30 may be immersed in the lens material, such as by casting the LED within the flashlight lens.

The central LED lamp 30 is preferably a high-brightness LED having a light output of at least about 65 lumens. In a typical flashlight embodiment, the lamp's output color is white, although this may be any color, depending on the application. The lamp has a monolithic LED chip 66 that provides an essentially lambertian output. The chip is larger than an effective point source, and thus limits the flashlight's minimum spot size when an image of the chip is focused on a target of illumination. The lamp has a protective cover 70 that may be a cast immersion lens encapsulating the LED chip, or a curved window enclosing the LED chip in a chamber. One example of such an LED is model LXHL-PW09 from Lumiled of San Jose, Calif. In alternative embodiments, the central LED may be replaced by other light sources.

The lens includes at least one offset bore 72 that is a cylindrical aperture having an axis parallel to the lens axis 34. The bore is positioned well away from the lens axis, and away from the flange 36 to avoid interference with the mechanical interface between the flange and the flashlight housing. The bore 72 is positioned just outside the periphery of the dome 44. In the preferred embodiment, the aperture is positioned between the outer limit of the front dome, and the outer limit of the rear protrusion 50.

A secondary LED lamp 32 is positioned in each of the apertures, with the number of apertures being based on the desired number of peripheral LEDs. In alternative embodiments, the LED 32 may be an alternative lighting source, although LEDs provide a desirable range of color (and non-visible spectrum) outputs that are preferred for many applications. The LED lamp 32 may be a conventional lamp having a cylindrical body with a curved forward collimating lens surface that encapsulates a small LED chip.

The peripheral LED 32 is shown with only the curved front surface proud of the peripheral surface 46. However, in alternative embodiments, the entire encapsulated portion of the lamp may be positioned forward, with a smaller bore 72 adequate to pass the electrical leads, to minimize the shadowing effects of the bore on the light output by the central LED. In other embodiments, the LED 32 may be positioned farther rearward. In this instance, the surface of the bore 72 may be provided with a specular finish, and possibly plated with a reflective coating, to reflect off-axis rays in the manner of a light pipe. One example of such an LED is model NSPW510BS from Nichia, and has an output in the range of 0.7 to 1.0 lumens, for a total output of all secondary lamps in the 1.4 to 2.0 lumens range.

In further alternative embodiments, the main lens 26 may be provided with small integrated lens elements on axis with each of the secondary LEDs, so that secondary LEDs may be positioned rearward of the lens, or rearward of the front lens surface.

The optical function of the lens 26 is illustrated by sample rays in the lower half of the figure. A central ray bundle 73 including axial ray 74, off axis rays 76 and 80, and those in between (as well as those mirrored in the lower portion) form a conical bundle, and are a large component of the entire output of the LED chip 66, because of the largely flat shape of the chip, and its lambertian output. This bundle is unobstructed by the secondary LED apertures, and is entirely focused on the target, in contrast to flashlights using reflectors. The peripheral rays of the central bundle such as ray 80 are refracted at the recessed surface 62 in a direction toward the axis 34, providing slight initial refraction toward collimation. This allows a larger initial bundle angle to encounter the central lens portion 44 than if the recess were a spherical surface centered on the lamp 30.

A peripheral bundle of rays includes rays 82, 84, and 86. Ray 82 is illustrated to approximate a ray nearly adjacent to the limiting ray 80 of the central bundle, and strikes the side wall 64 of the recess adjacent to the junction with the floor 62. This ray, like those others striking the side wall 64 at an angle, is refracted away from the axis 34, so that it strikes the forward portion of surface 50. Thus, a shadow is formed between the two bundles by the angled surfaces of the recess, so that no rays directly pass through the peripheral surface 46 or impinge on the flange, as they would with a spherical recess. If this occurred, such rays would diverge undesirably from the otherwise approximately collimated beam. Each of the rays of the peripheral bundle are essentially collimated (at least within each radial plane illustrated) and impinge on the surface 50 at a common angle less than the critical angle based on the optical index of the lens material. With this angle of incidence sufficiently offset from the perpendicular, each ray is totally internally reflected to a path that is essentially parallel to the optical axis.

With each of the peripheral LED lamps 32 being as small in diameter as practical and as far off axis as practical, the light lost by from the peripheral bundle of rays is minimized. First, the apertures shadow only small angular sectors of the outer lens portion, each subtending only 50 degrees in the preferred embodiment.

This disclosure is made in terms or preferred and alternative embodiments, and is not intended to be so limited. Alternative embodiments may provide the lens 26 with axial optical paths that provide axial passage of collimated light from the secondary LEDs, without actual bores formed in the lens. This would allow the lens body in these locations to pass light rays from each LED without disruption, and would limit the disruption of the central LED rays to those locations at the reflector surface where the surface was oriented (presumably perpendicular to the optical axis) to pass the secondary LED light, instead of to reflect the central LED rays.

The invention claimed is:

1. A flashlight comprising:

a lens having a curved refracting surface defining an optical axis;

a first light source positioned on the optical axis;

a second light source spaced apart from the first light source away from the optical axis; and the lens defining an aperture registered with the second light source.

2. The flashlight of claim 1 wherein the lens defines a recess receiving the first light source, and wherein the aperture is located away from the recess.

3. The flashlight of claim 1 wherein a portion of the lens intervenes between the first and second light sources.

4. The flashlight of claim 1 wherein the first light source emits at least some light in a direction toward the second light source, and wherein a portion of the lens intercepts and internally reflects the at least some light and redirects it generally along the optical axis.

5. The flashlight of claim 1 wherein the first light source is an LED.

6. The flashlight of claim 1 wherein the first and second light sources emit light of different colors.

7. The flashlight of claim 1 wherein the aperture is a cylindrical bore.

8. The flashlight of claim 1 wherein the aperture is parallel to the optical axis.

9. The flashlight of claim 1 wherein the lens has a central portion configured to transmit axially-emitted light from the first light source, and the lens having a peripheral portion having an internally reflective surface configured to reflect laterally-emitted light from the light source in a direction more closely aligned with the optical axis.

10. The flashlight of claim 9 wherein the aperture is defined in the peripheral portion of the lens.

11. The flashlight of claim 2 wherein the recess has a rim positioned at a selected radial distance from the optical axis, and wherein the aperture is positioned radially beyond the selected distance.

12. A flashlight comprising:

a lens having a curved refracting surface defining an optical axis;

a first light source positioned on the optical axis;

a second light source spaced apart from the first light source away from the optical axis;

the lens having a light-transmissive portion directly intervening between the first and second light sources; and wherein the light-transmissive portion has a lens surface portion angled at a sufficient angle with respect to light rays emitted from the first source, such that the light rays are internally reflected at the lens surface portion.

13. A flashlight comprising:

a lens having a curved refracting surface defining an optical axis;

a first light source positioned on the optical axis;

a second light source spaced apart from the first light source away from the optical axis;

the lens having a light-transmissive portion directly intervening between the first and second light sources; and wherein the lens includes a transmission path for the second light source parallel to the optical axis.

14. The flashlight of claim 13 wherein the transmission path is a passage defined in the lens.

15. A flashlight comprising:

a lens having a curved refracting surface defining an optical axis;

a first light source positioned on the optical axis;

a second light source spaced apart from the first light source away from the optical axis;

the lens having a light-transmissive portion directly intervening between the first and second light sources; and wherein the lens has a central portion configured to transmit axially-emitted light from the first light source, and wherein an aperture is defined in a peripheral portion of the lens away from the central portion.

16. The flashlight of claim 15 wherein the lens defines a recess receiving the first light source, and wherein the aperture is located away from the recess.

17. A flashlight comprising:

a lens having a curved refracting surface defining an optical axis;

a first light source positioned on the optical axis;

a second light source spaced apart from the first light source away from the optical axis;

the lens having a light-transmissive portion directly intervening between the first and second light sources; and wherein the first light source emits at least some light in a direction toward the second light source, and wherein a portion of the lens intercepts and internally reflects the at least some light and redirects it generally along the optical axis.

* * * * *